US005785569A

United States Patent [19]

Stansbury et al.

[11] Patent Number: 5,785,569

[45] Date of Patent: Jul. 28, 1998

[54] METHOD FOR MANUFACTURING HOLLOW SPACERS

[75] Inventors: Darryl M. Stansbury; Jim Hofmann; Charles M. Watkins, all of Boise, Id.

[73] Assignee: Micron Technology, Inc., Boise, Id.

[21] Appl. No.: 621,490

[22] Filed: Mar. 25, 1996

[51] Int. Cl.[6] ..... H01J 9/26

[52] U.S. Cl. ..... 445/25; 445/24

[58] Field of Search ..... 29/897.33, 897.31; 65/58; 156/292; 445/24, 25

[56] References Cited

U.S. PATENT DOCUMENTS

| | | | |
|---|---|---|---|
| 5,186,670 | 2/1993 | Doan et al. | 445/24 |
| 5,205,770 | 4/1993 | Lowrey et al. | 445/24 |
| 5,210,472 | 5/1993 | Casper et al. | 315/349 |
| 5,229,331 | 7/1993 | Doan et al. | 437/228 |
| 5,259,799 | 11/1993 | Doan et al. | 445/24 |
| 5,302,238 | 4/1994 | Roe et al. | 156/643 |
| 5,406,170 | 4/1995 | Uemura et al. | 445/24 |
| 5,413,513 | 5/1995 | Horne et al. | 445/24 |
| 5,561,343 | 10/1996 | Lowe | 445/24 |
| 5,562,517 | 10/1996 | Taylor et al. | 445/24 |
| 5,634,837 | 6/1997 | Nishimura et al. | 445/25 |

OTHER PUBLICATIONS

Cathey, David A., Jr., "Field Emission Displays", published in VLSI, Taiwan, May–Jun., 1995.

*Primary Examiner*—P. Austin Bradley
*Assistant Examiner*—Jeffrey T. Knapp
*Attorney, Agent, or Firm*—Stephen A. Gratton

[57] ABSTRACT

A method for manufacturing hollow spacers includes forming an elongated tube from sheets of material, and then separating a transverse segment of a desired thickness from the tube to form a spacer. For forming spacers for a field emission display, the sheets can be glass and the adhesive can be glass frit paste. The tube can be segmented by attaching the assembled tube to a support piece and then saw cutting the tube.

29 Claims, 3 Drawing Sheets

METHOD FOR MANUFACTURING HOLLOW SPACERS

FIELD OF THE INVENTION

This invention relates generally to the manufacture of hollow spacers and particularly to an improved process for manufacturing hollow spacers made of glass or other materials for use in field emission display packages.

BACKGROUND OF THE INVENTION

Flat panel displays have recently been developed for visually displaying information generated by computers and other electronic devices. These displays can be made lighter and require less power than conventional cathode ray tube displays. One type of flat panel display is known as a cold cathode field emission display (FED).

A field emission display uses electron emissions to illuminate a cathodoluminescent display screen (termed herein a "face plate") and generate a visual image. An individual field emission pixel typically includes emitter sites formed on a base plate. The base plate includes the circuitry and devices that control electron emissions from the emitter sites. The emitted electrons pass through a vacuum space and strike phosphors contained on the face plate. The phosphors are excited to a higher energy level and release photons to form an image.

The base plate and emitter sites for a field emission display are ideally located a set distance from the face plate. In order to provide a uniform resolution, focus and brightness, it is important that this distance between the base and face plates be uniform across the total surface area of the plates. In addition, in order to achieve reliable display operation during electron emission from the emitter sites, a vacuum on the order of $10^{-6}$ Torr or less is required. The vacuum is formed in the sealed space contained within the field emission display and places high stresses on the face plate and base plate and the components which support the plates.

Typically, a high level of control must be utilized during the manufacturing process to ensure that the spacing between the base plate and the face plate is uniform. For this reason spacers are typically formed between the base plate and the face plate. This type of spacer is sometimes referred to an interelectrode spacer. For display devices having a relatively small surface area, these interelectrode spacers can be formed with an inside diameter and an outside diameter. A hollow center portion of the spacer forms the interior of the device package and a peripheral support area of the spacer forms the sidewalls of the package. In light of the environment in which these spacers are to be used, the material selection is critical and the manufacturing tolerances are extremely small.

In the past, it has been possible to produce hollow spacers by slicing stock tubing having the standard external and internal dimensions. For use in field emitter displays, one suitable material for forming spacers is glass tubing. While glass tubing is available in standard sizes shapes, only a limited variety of sizes and shapes is available. Alternatively, manufacturing custom glass tubing is extremely expensive. Common methods of manufacturing glass tubing is through glass drawing or through the use of glass welding. Both processes are relatively expensive and require highly skilled labor and a large capital investment.

In view of the foregoing, it is an object of the present invention to provide an improved method for manufacturing hollow spacers particularly suited for use in electronic devices including field emission displays.

It is a further object of the present invention to provide a method for manufacturing hollow spacers having a variety of peripheral shapes and sizes, with tight dimensional tolerances, and without the use of expensive tooling, labor and materials.

It is another object of the present invention to provide a method for manufacturing hollow interelectrode spacers for electronic display devices, using materials compatible with the operation and construction of the display devices.

It is yet another object of the present invention to provide a hollow interelectrode spacer for a field emission display that is capable of withstanding the forces resulting from the display vacuum and which has a coefficient of thermal expansion (CTE) that matches other elements of the display.

Other objects, advantages and capabilities of the present invention will become more apparent as the description proceeds.

SUMMARY OF THE INVENTION

In accordance with the present invention, an improved method for manufacturing spacers is provided. The spacers include an inside diameter and an outside diameter and a hollow interior portion. In the illustrative embodiment, the spacers are generally rectangular in shape and are used to construct a field emission display package. The improved method, generally stated, includes the steps of assembling an elongated tube from flat sheet stock, and then transversely cutting the tube to form hollow spacers with a desired thickness.

One assembly sequence begins by forming appropriately dimensioned sheet components from standard glass sheet stock having a suitable coefficient of thermal expansion (CTE). These sheet components can include: a base sheet, a top sheet, two side sheets and a pair of end sheets. Using an adhesive the sheets can be assembled into a rectangular tube having closed ends. A preferred adhesive for sheet components formed of glass is a glass frit paste made of frit powder and a solvent such as terpineol ($C_{10}H_{17}OH$). The glass frit paste can also have a CTE that closely matches that of the sheet components. The assembly step can be assisted using jigs to hold the sheet components in place. Following assembly of the rectangular tube, segments of the tube are separated by cutting to form a plurality of spacers having a desired thickness. The cutting step can be assisted using a support piece attached to the assembled tube.

DETAILED DESCRIPTION OF THE PREFERRED EMBODIMENTS

Figure 1:
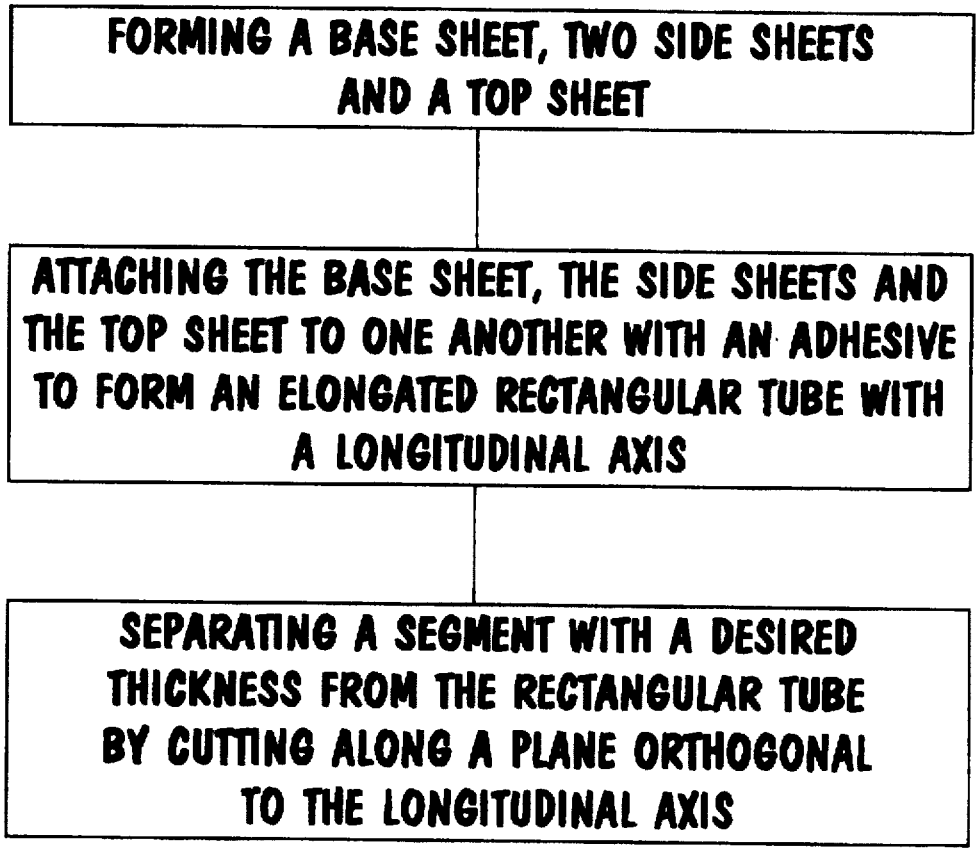
FIG. 1 is a flow diagram of steps involved in forming a spacer in accordance with the invention.

With reference to FIG. 1, a method for manufacturing a spacer includes the steps of: (1) forming a base sheet, two side sheets and a top sheet; (2) attaching the base sheet, the side sheets and the top sheet to one another with an adhesive to form an elongated rectangular tube with a longitudinal axis; (3) separating a segment with a desired thickness from the rectangular tube by cutting along a plane orthogonal to the longitudinal axis.

Figure 2:
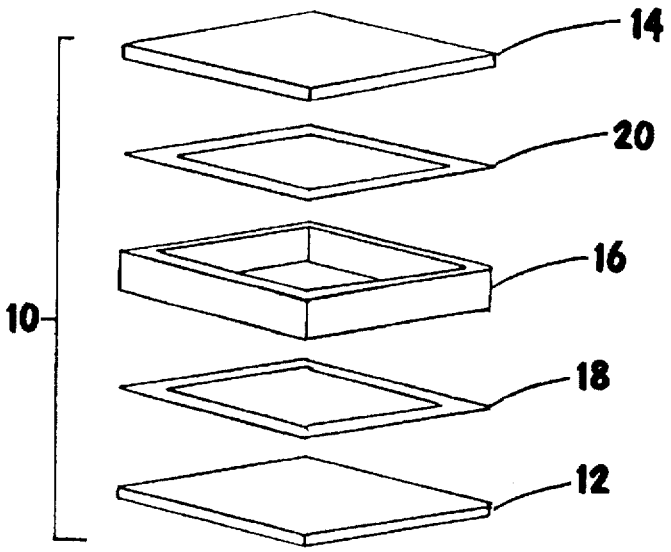
FIG. 2 is an exploded view of the major structural components of a field emission display package constructed in accordance with the invention.

Referring to FIG. 2, the major structural components of one type of field emission display package 10 ("FED") are shown. The display package 10 includes a base plate 12 and a face plate 14 which are separated by a spacer 16. Various components of a field emission display (e.g., emitter sites, display screen etc.) are formed on the base plate 12 and face plate 14 using techniques that are known in the art. A seal ring 18 is formed between the base plate 12 and the spacer 16. Similarly, a seal ring 20 is formed between the face plate 14 and the spacer 16. In the assembled display package 10, the spacer 16 seals the hollow interior portion of the display package 10 which is evacuated to a negative pressure.

Figure 3:
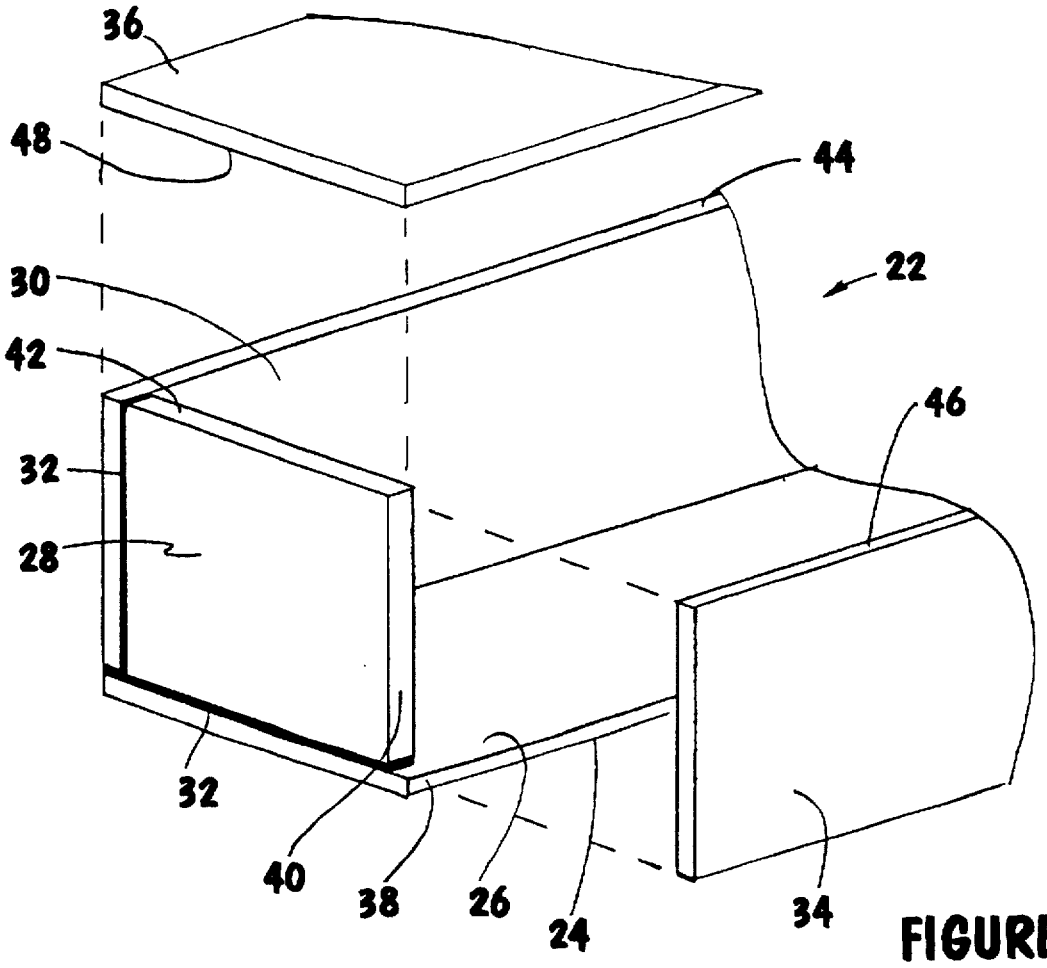
FIG. 3 is a partial perspective view showing a step in the method of the invention wherein an elongated rectangular tube is being assembled.
Figure 4:
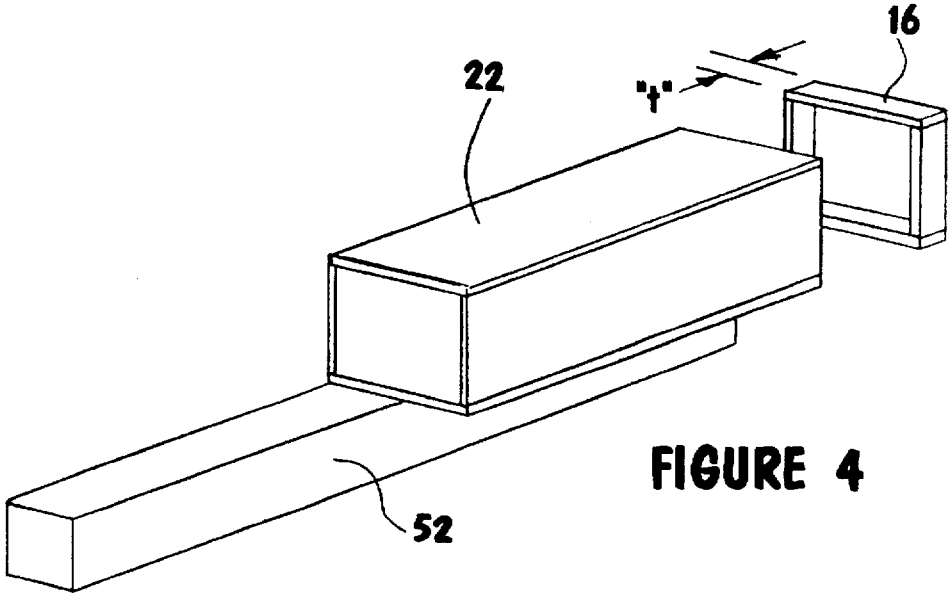
FIG. 4 is a perspective view of a completed rectangular tube assembled on a support piece and a segment that has been separated from the rectangular tube to form a spacer with a desired thickness.

For forming the spacer 16 and as shown in FIG. 3, a rectangular tube 22 having the appropriate internal and external dimensions is constructed. As shown in FIG. 4, once the rectangular tube 22 is assembled, the tube 22 is cut transversely into spacers 16 having a desired thickness "t".

Referring to FIG. 3, the rectangular tube 22 includes a base sheet 24 which has a top side 26. Mounted onto the top side 26 of the base sheet 24 is an end sheet 28. Attached to both the base sheet 24 and the end sheet 28 is a side sheet 30. The base sheet 24, end sheet 28 and side sheet 30 are fixedly attached to each other by the use of an adhesive 32.

The base sheet 24, end sheet 28 and side sheet 30 can be made from a variety of rigid materials such as plastic, metal or glass. If the base plate 12 and face plate 14 of the field emission display package 10 are formed of glass, the spacer 16 is preferably also formed of glass. Preferably, the coefficient of thermal expansion (CTE) for the spacer 16 is the same, or closely matches, the coefficient of thermal expansion for the base plate 12 and the face plate 14 of the display package 10. One suitable glass is a transparent high temperature glass such as Corning 7059 glass or Corning 1737 glass. In general, this type of glass has a low coefficient of thermal expansion.

For forming the rectangular tube 22 out of glass, the adhesive 32 can be a glass frit material. The glass frit material can be either a vitreous frit or a devitrifying frit. Preferably the glass frit has a coefficient of thermal expansion (CTE) that closely matches that of the rectangular tube 22. One suitable glass frit material is commercially available from Nippon Electric Glass America, Inc. and is designated LS-0104. Another suitable glass frit material is SCC-7 from Sem-Com Company, Toledo Ohio.

Alternately in place of glass frit, the adhesive 32 can be formed of a low melting point metal such as indium or an alloy of indium.

With the adhesive 32 formed of glass frit, the frit material can be applied as a viscous paste using a screen printing process and suitable stencil (not shown), or can be applied by brushing, or as a bead from a dispensing nozzle. The paste can be formed by combining the glass frit with a solvent such as pine oil.

Still referring FIG. 3, the end sheets 28 for the rectangular tube 22 are utilized primarily to add structural rigidity during the assembly process. In some instances, it may be preferable to assemble the rectangular tube 22 without the use of one or more end sheets 28. In addition, an alignment jig (not shown) can be used during assembly of the tube 22 to support and align the sheet components.

As shown in FIG. 3, the rectangular tube 22 is completed by a second side sheet 34 and a top sheet 36. Side sheet 34 and top sheet 36 are fixedly attached to the other sheet components of the rectangular tube 22 by applying adhesive 32 as previously described. At the point of assembly shown in FIG. 3, adhesive 32 for side sheet 34 is applied on the top side 26 of the base sheet 24 parallel to the peripheral edge 38 of base sheet 24. In addition, adhesive 32 for the top sheet 36 is applied along the remaining exposed edges 40, 42 of the end sheet 28. In a similar manner, adhesive 32 for the top sheet 36 is formed on the edge 44 of the side sheet 30 and on the edge 46 of side sheet 34. Once the required adhesive 32 is applied, side sheet 34 can be pressed into contact with the base sheet 24 and end sheet 28. Additionally, the top sheet 36, and specifically its bottom side 48, can be pressed into contact with the adhesive 32 on edges 42, 44 and 46.

While the construction of rectangular tube 22 is shown with reference to only one end of tube 22, those skilled in the art will appreciate that an additional end sheet can be formed at the opposite end (not shown) and that similar applications of adhesive 32 can be made.

Figure 3A:
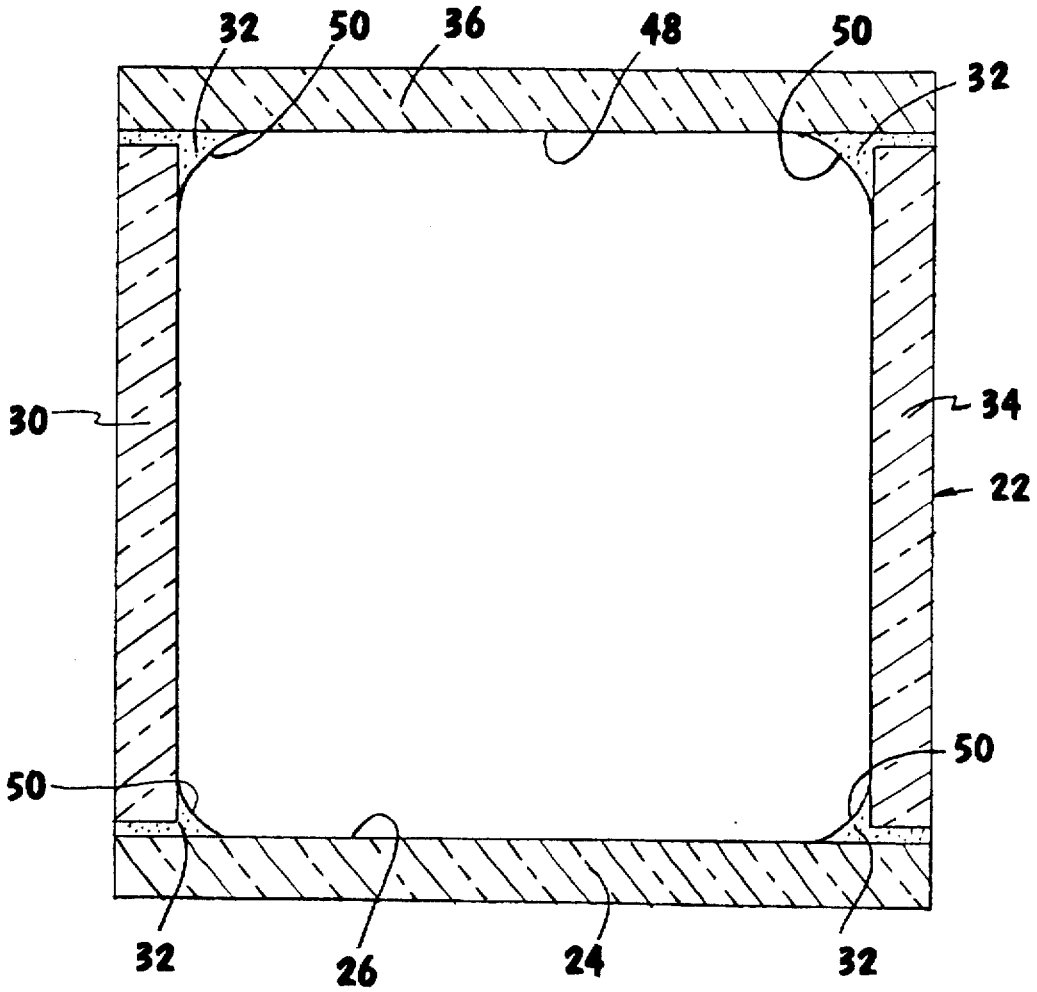
FIG. 3A is a transverse cross-sectional view of the completed rectangular tube.

Referring to FIG. 3A, a cross sectional view of the completed rectangular tube 22 is shown. As previously described, the rectangular tube 22 includes a base sheet 24 having a top side 26. Additionally, the rectangular tube 22 includes side sheet 30, side sheet 34, and top sheet 36 having a bottom side 48. Still further, adhesive 32 is shown between the various components. Preferably sufficient adhesive 32 is used between the various components to form a fillet 50 at each joint between components. Once cured, the adhesive fillet 50 will help minimize or dissipate stress at each joint between the components of the rectangular tube 22. With the adhesive 32 formed of glass frit paste a firing step must be employed to cure the frit to the sheet components without causing damage to the glass or frit. By way of example, glass frit paste can be cured at a temperature of from 200° C. to 700° C. for a time period of from several minutes to several hours.

Referring to FIG. 4, the rectangular tube 22 and the spacer 16 that has been separated from the tube 22 are shown. As shown in FIG. 4, in some instances, it can be beneficial to attach a support piece 52 to the tube 22 for supporting the tube 22 for saw cutting. A non permanent adhesive can be used to attach the tube 22 to the support piece 52.

Saw cutting can be from the outside diameter of the tube 22, or if one of the end sheets 28 has been omitted or cut, from the inside diameter of the tube 22. The direction and plane of the cut are preferably orthogonal, or transverse, to the longitudinal axis of the tube 22. The saw cutting process is controlled to form the separated spacers 16 with a desired thickness "t".

Using the method of the invention spacers 16 having a thickness ("t") as small as about 0.040 inches can be formed. This thickness is significantly less than equivalent spacers formed using a conventional scribing process for flat sheets. Using conventional scribing process, spacers smaller than 0.060 inches are generally not possible.

EXAMPLE

For purposes of manufacturing a FED 10 having a base plate 12 and a face plate 14 made of glass, and a spacer 16 constructed in accordance with the invention, the following procedure is exemplary. For purposes of clarity, the same numerals utilized and identified with reference to FIGS. 1–4 are utilized.

Initially the base plate 16 and face plate 14 for the field emission display are formed. The base plate 16 contains the emitter sites, grid and circuit elements necessary to initiate electron emission to form a visual image on the face plate. The face plate 14 includes a display screen comprising phosphors and a transparent electrode. U.S. Pat. No. 5,302,238 to Roe et al.; U.S. Pat. No. 5,210,472 to Casper et al.; U.S. Pat. No. 5,232,549 to Cathey et al.; U.S. Pat. No. 5,205,770 to Lowrey et al.; U.S. Pat. No. 5,186,670 to Doan et al.; and U.S. Pat. No. 5,229,331 to Doan et al.; all of which are incorporated by reference, disclose methods for forming field emission displays including the above components.

For forming the spacer 16, the base sheet 24, the end sheets 28, the side sheets 30 and 34 and the top sheet 36 are formed. As a stock material, it is preferred that glass sheet having a coefficient of thermal expansion (CTE) close to that of the base plate 16 and face plate 14 be used. One type of transparent glass sheet which that can be used is Corning 7059 glass or Corning 1737 glass. However, other high temperature glass sheets or materials having similar characteristics could also be utilized. Once the external and internal dimensions of the spacer 16 are known, the sheet components identified above can be cut from the sheet stock by etching, breaking, cutting or similar methods known in the art.

With the sheet components formed to the proper dimensions, the sheet components are assembled to form a rectangular tube 22. First, an adhesive 32 is applied to base sheet 24. While it is possible to apply the adhesive 32 uniformly across the top side 26 of base sheet 24, it is preferred that the application of the adhesive 32 be localized to the region directly adjacent the edge of the base sheet 24 and around the entire periphery of the base sheet 24. To the extent that the end sheets 28 are not to be utilized, adhesive need not be applied along that edge where the end sheets 28 would normally be located. The adhesive 32 can be formed of glass frit paste applied to the top side 26 of the base sheet 24 using a stencil or can be applied using a dispensing nozzle or by other methods known in the art.

The glass frit paste can be formed of frit powder mixed with a solvent vehicle such as terpineol. For example, one suitable glass frit paste is commercially available from Nippon Electric Glass America, Inc. and is designated LS-0104. Another suitable glass frit material is SCC-7 from Sem-Com Company, Toledo Ohio. The glass frit paste can be either a vitreous frit or a devitrifying frit. The glass frit paste should preferably have a coefficient of thermal expansion that closely matches that of the sheet components of the rectangular tube. After application of the glass frit paste to the sheet components the paste is cured by heating to a temperature of 200° C. to 700° C. for several minutes or more.

As those skilled in the art will appreciate, the assembly of the box has been described in a particular order. On the other hand, assembly in an alternative order is possible without departing the spirit and scope of the present invention. Notwithstanding the order of assembly between the base sheet 24, the side sheets 30 and 34, and the top sheet 36, and notwithstanding whether end sheets 28 are utilized, it is critical for the joints between the respective side sheets and base sheet 24 and top sheet 36 to be substantially gas tight.

With reference to FIG. 2, the spacer 16, the base plate 12, and the face plate 14, formed separately as described above, are ready to be assembled to form the FED package 10. The FED assembly process includes forming the seal ring 18 between the spacer 16 and the base plate 12 and the seal ring 20 between the spacer 16 and the face plate 14.

In addition, the assembly process includes evacuating the interior of the package 10 to a pressure of about $5.0\times10^{-7}$ Torr. The seal rings 18, 20 can be formed and the interior of the package 10 can be evacuated using a sealing and evacuation process as described in U.S. patent application Ser. No. 08/538,498, filed Sep. 29, 1995 entitled "Method For Evacuating And Sealing Field Emission Displays", and incorporated herein by reference.

While the invention has been described in connection with an illustrative embodiment for forming rectangular spacers, it is to be understood that spacers having other polygonal peripheral shapes (e.g., triangular, hexagonal) can also be formed using the method of the invention. Accordingly, certain changes and modifications can be made without departing from the scope of the invention as defined by the following claims.

What is claimed is:

1. A method for manufacturing an interelectrode spacer for a field emission display package comprising the steps of:

providing a plurality of flat sheets of a material;

assembling a hollow tube by attaching the flat sheets to one another using an adhesive, said hollow tube including a longitudinal axis; and separating a segment of a desired thickness from the tube wherein said thickness corresponds to a desired interelectrode spacing.

2. The method as claimed in claim 1 and wherein separating comprises cutting the tube along a plane orthogonal to the longitudinal axis.

3. The method as claimed in claim 1 and wherein the adhesive has a coefficient of thermal expansion that is substantially equal to that of the flat sheets.

4. The method as claimed in claim 1 and wherein four flat sheets of material are provided and said four sheets are assembled to form a hollow tube with an elongated rectangular shape.

5. The method as claimed in claim 1 and further comprising assembling an end plate on said hollow tube.

6. A method for manufacturing an interelectrode spacer for a field emission display package comprising the steps of:

forming a base sheet, two side sheets and a top sheet, said sheets formed in a flat planar shape;

forming an elongated rectangular tube having a longitudinal axis, by attaching the side sheets to the base sheet, and by attaching the top sheet to side sheets using an adhesive; and cutting the bottom sheet, the side sheets and the top sheet along a plane orthogonal to the longitudinal axis to remove a segment with a desired thickness wherein said thickness corresponds to a desired interelectrode spacing.

7. The method as claimed in claim 6 and wherein the sheets are comprised of glass and the adhesive is selected from the group consisting of glass frit paste, indium and an indium alloy.

8. The method as claimed in claim 6 and further comprising forming the adhesive of glass frit paste and curing the glass frit paste by heating to a temperature between 200° C. to 700° C.

9. The method as claimed in claim 6 and further comprising providing end sheets and forming the rectangular tube with closed ends.

10. The method as claimed in claim 6 wherein the bottom sheet, the side sheets and the top sheet are aligned during manufacture using a jig.

11. The method as claimed in claim 6 further comprising the step of attaching the rectangular tube onto a support piece for support during the cutting step.

12. The method as claimed in claim 6 and wherein the adhesive has a coefficient of thermal expansion that is substantially equal to that of the base sheet, side sheets and top sheet.

13. The method as claimed in claim 6 and further comprising assembling the spacer in a field emission display.

14. A method of manufacturing an interelectrode spacer for a field emission display package comprising the steps of:

forming a base sheet, two side sheets and a top sheet from sheet stock;

applying an adhesive to the base sheet, to the side sheets or to the top sheet;

attaching the side sheets to the base sheet, and the top sheet to the side sheets, to form a rectangular tube having substantially gas tight seals between the side sheets and the base sheet, and between the sides sheets and the top sheet;

cutting the bottom sheet, the side sheets and the top sheet to separate a segment with a desired thickness wherein said thickness corresponds to a desired interelectrode spacing.

15. The method as claimed in claim 14 and wherein the adhesive is comprised of indium or an indium alloy.

16. The method as claimed in claim 14 and wherein the adhesive is applied using a stencil.

17. The method as claimed in claim 14 and wherein the adhesive is applied in a bead using a dispensing nozzle.

18. The method as claimed in claim 14 and wherein the bottom sheet, the side sheets and the top sheet are aligned during the attaching steps using a jig.

19. The method as claimed in claim 14 and wherein the rectangular tube is attached to a support piece for the cutting step.

20. The method as claimed in claim 14 and further comprising forming an end sheet and attaching the end sheet to an end of the rectangular tube.

21. The method as claimed in claim 14 and wherein the spacers have a thickness of between about 0.040 inches to 0.060 inches.

22. The method as claimed in claim 14 and further comprising assembling the spacer in a field emission display.

23. The method as claimed in claim 14 and wherein the sheets are comprised of glass and the adhesive is glass frit applied as a paste.

24. The method as claimed in claim 23 and further comprising curing the glass frit paste by heating to a temperature of between 200° C. to 700° C.

25. A method for forming a field emission display package comprising:

forming a base plate including field emitter sites;

forming a face plate including a display screen;

assembling an elongated hollow tube from flat sheets of material attached to one another using an adhesive;

separating a transverse segment of a desired thickness from the hollow tube to form a spacer;

placing the spacer between the base plate and face plate; and forming a gas tight seal between the spacer and the base plate and between the spacer and the face plate.

26. The method as claimed in claim 25 and wherein the flat sheets are comprised of glass and the adhesive is comprised of glass frit applied as a paste.

27. The method as claimed in claim 25 and further comprising evacuating an interior of the package while the gas tight seal is formed.

28. The method as claimed in claim 25 and further comprising forming the hollow tube with closed ends by attaching end sheets to the hollow tube.

29. The method as claimed in claim 25 and wherein the spacers have a thickness of between about 0.040 inches to 0.060 inches.

* * * * *

UNITED STATES PATENT AND TRADEMARK OFFICE

CERTIFICATE OF CORRECTION

PATENT NO. : 5,785,569
DATED : July 28, 1998
INVENTOR(S) : Darryl M. Stansbury; Jim Hofmann; Charles M. Watkins It is certified that error appears in the above-identified patent and that said Letters Patent is hereby corrected as shown below:

Column 1,
After the title, insert:

-- GOVERNMENT RIGHTS

This invention was made with United States Government support under contract No. DABT63-93-C-0025 awarded by the Advanced Research Projects Agency (ARPA). The United States Government has certain rights in this invention. --

Signed and Sealed this

Sixth Day of November, 2001

*Attest:*

Nicholas P. Godici

*Attesting Officer*

NICHOLAS P. GODICI
*Acting Director of the United States Patent and Trademark Office*